United States Patent [19]

Gensberger

[11] Patent Number: 4,648,809

[45] Date of Patent: Mar. 10, 1987

[54] DEVICE FOR CONVEYANCE OF A PRESSURE MEDIUM, ESPECIALLY OIL

[75] Inventor: Karl Gensberger, Ingbert, Fed. Rep. of Germany

[73] Assignee: Flutec Fluidtechnische Gerate GmbH, Sulzbach, Fed. Rep. of Germany

[21] Appl. No.: 678,558

[22] PCT Filed: Apr. 6, 1984

[86] PCT No.: PCT/DE84/00081

§ 371 Date: Nov. 9, 1984

§ 102(e) Date: Nov. 9, 1984

[87] PCT Pub. No.: WO84/04135

PCT Pub. Date: Oct. 25, 1984

[30] Foreign Application Priority Data

Apr. 9, 1983 [DE] Fed. Rep. of Germany ..... 3312828

[51] Int. Cl.[4] ..... F04B 17/00; F04B 35/00; F04B 39/02; F04B 39/06

[52] U.S. Cl. ..... 417/366; 417/419

[58] Field of Search ..... 417/419, 312, 366, 369, 417/415; 310/54

[56] References Cited

U.S. PATENT DOCUMENTS

| | | | |
|---|---|---|---|
| 2,844,101 | 7/1958 | Burns et al. | 310/54 |
| 2,961,149 | 11/1960 | Hull | 417/312 |
| 3,010,401 | 11/1961 | Granqvist | 417/366 |
| 3,309,009 | 3/1967 | Culk | 417/419 |
| 3,992,133 | 11/1976 | Brunner | 417/366 |
| 4,115,038 | 9/1978 | Litzenberg | 417/369 |
| 4,184,810 | 1/1980 | Dyhr et al. | 417/363 |
| 4,198,191 | 4/1980 | Pierce | 310/54 |
| 4,201,523 | 5/1980 | Olofsson | 417/312 |
| 4,540,382 | 9/1985 | Wilson | 417/415 |

FOREIGN PATENT DOCUMENTS 2555562 10/1975 Fed. Rep. of Germany .

*Primary Examiner*—Carlton R. Croyle
*Assistant Examiner*—Donald E. Stout
*Attorney, Agent, or Firm*—Roylance, Abrams, Berdo & Goodman

[57] ABSTRACT

A device for conveyance of a pressure medium, especially pressure oil, has an electric motor with a vertical shaft and a pump driven by this shaft. The housing has a bottom part. To absorb the operational noises of the device, the bottom part is constructed as stable element of large mass. The electric motor and its housing are fastened on the bottom part.

13 Claims, 2 Drawing Figures

DEVICE FOR CONVEYANCE OF A PRESSURE MEDIUM, ESPECIALLY OIL

FIELD OF THE INVENTION

The present invention relates to a device for conveying a pressure medium including a pump driven by a shaft coupled to an electric motor.

BACKGROUND OF THE INVENTION

In a known device of this type, the electric motor is mounted on top of the housing. When the housing top is assembled with the housing bottom carrying the pump, a complete, three-dimensional, compact unit is formed. However, this conventional arrangement is noisy.

SUMMARY OF THE INVENTION

An object of the present invention is to provide a device for conveying a pressure medium which absorbs and dampens its operational noises.

Another object of the present invention is to provide a device for conveying a pressure medium which cools the electric motor.

The foregoing objects are basically obtained by a device for conveying a pressure medium, especially oil, comprising an electric motor having a perpendicular shaft and a stator, a pump coupled to and driven by the shaft, a thick walled pump housing surrounding the pump, and a motor housing fixedly coupled to the pump housing at a first distance from it at an outside surface of the motor housing. The motor housing has pairs of longitudinal fins extending axially along and radially inwardly from the motor housing and supporting the stator. A motor cover is fixedly coupled to the motor housing. First and second bearings support the shaft and are mounted in the pump housing and the motor housing, respectively. Tie rods are located interiorly of the motor housing with each tie rod located between a respective pair of fins and connecting the motor cover to the pump housing to prevent relative rotation and movement therebetween. A housing casing surrounds the motor housing and is fixedly connected to and sealed to the pump housing. A housing cover is spaced from the motor cover and is coupled to and sealed to the housing casing. Clearances between the housing casing and the motor housing and between the motor housing and the pump housing permit fluid to flow therethrough.

Since the pump housing is constructed as a stable member of a large mass, and the electric motor as well as the pump are mounted on this pump housing, the parts producing noises during operation are connected directly with a stable housing member forming a bottom part, and the operational noises are greatly damped. By mounting the electric motor and the pump on this housing member, the total mass of this bottom part and the elements connected with it are increased thereby. A reduction in operational noises is obtained with the compact structure.

These features also permit the housing to serve as storage container. The pressure medium found in the storage container absorbs noise and simultaneously cools the electric motor. When a cup-shaped top part is changed for a top part of another size and/or shape, the storage container can be changed as desired, both in size and in shape, without requiring a change in the other parts of the device.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
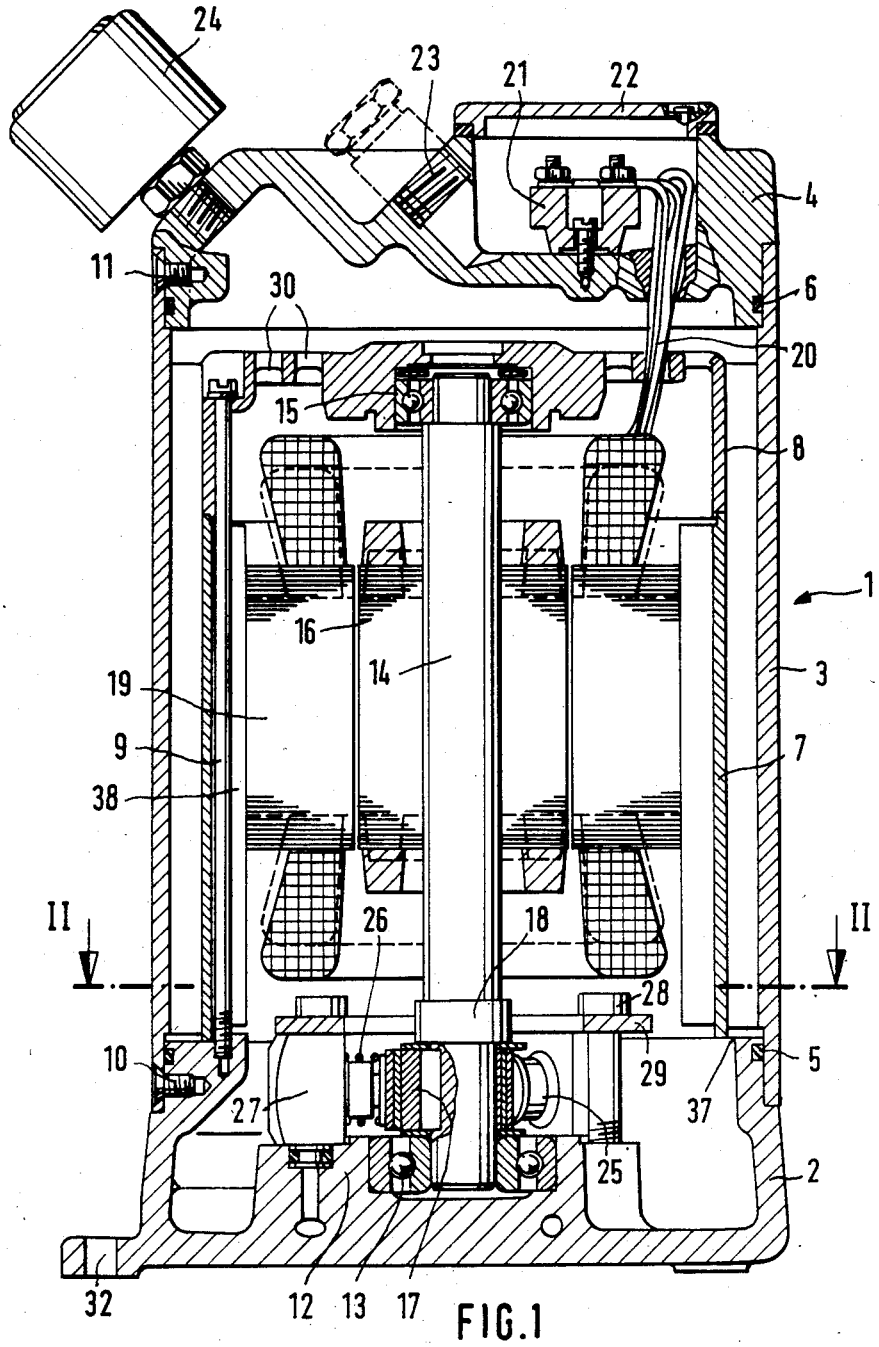
FIG. 1 is a diagrammatic, side elevational view in section of a device for conveying pressure oil according to the present invention, taken along line I—I of FIG. 2.
Figure 2:
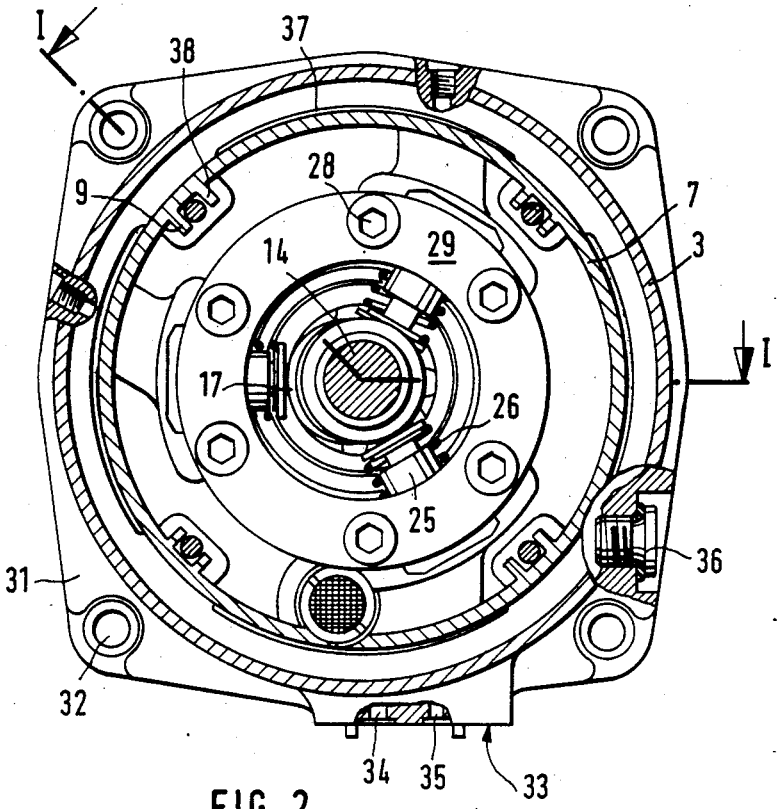
FIG. 2 is a diagrammatic top plan view in section taken along line II—II of FIG. 1.

A housing 1 of the device has a pump housing or bottom part 2 constructed as a stable, heavy, thick-walled element of large mass and formed particularly of cast iron or spheroidal graphite iron. The ratio of wall thickness of part 2 to its outside diameter is between 1/30 and 1/70, preferably is between 1/40 and 1/60, especially 1/50.

A tubular housing casing 3 having an outside diameter corresponding essentially to the outside diameter of pump housing or bottom part 2, is mounted on bottom part 2. The bottom of casing 2 is tapered on the inside and rests on an outside shoulder of bottom part 2. Casing 3 supports a thick-walled housing cover 4, which is likewise set in a tapered end of casing 3. Housing cover 4 has a corresponding outside shoulder. Housing casing 3 and housing cover 4 form the top part of housing 1 which mates with bottom part 2. The clearances between bottom part 2 and casing 3, as well as between casing 3 and cover 4, are packed by packing rings 5 and 6, respectively.

A smaller diameter, tubular motor casing or housing 7 rests at one end on the top of bottom part 2. Casing 7 is spaced radially from housing casing 3. A cup-shaped motor cover 8 is mounted on casing 7 at some axial spacing from housing cover 4. Motor housing 7 extends from motor cover 8. Motor housing 7 is fastened by means of tie rods 9 arranged in a circle on housing bottom 2. The tie rods are screwed into radially inward projecting brackets formed as part of bottom part 2. Screws 10, arranged perpendicular to the longitudinal axis and distributed around the periphery of housing casing 3, mount casing 3 on bottom part 2. Corresponding screws 11 pass through the top end of casing 3 to fasten cover 4.

An axial, pedestal-like protrusion 12 is located in the middle of bottom part 2. In the middle of protrusion 12, a roller bearing 13 is set. Bearing 13 supports a vertical shaft 14 at its bottom end. The top end of shaft 14 is mounted in a roller bearing 15 located in motor cover 8. Shaft 14 nonrotatably supports a drive rotor 16 of an electric motor at the shaft top end and a pump rotor 17 at the shaft bottom end. Between the two rotors is a shaft collar 18. Drive rotor 16 cooperates with an electric coil or stator 19 to form the electric motor.

The power connection wires 20 for the coil pass through motor cover 8 and housing cover 4 to a lug strip 21. Lug strip 21 is located in a recess in housing cover 4, which recess is covered on its outside by a sealed cover plate 22. An oblique bore 23 guides and feeds the power connection wire to lug strip 21. Another oblique bore on the side of housing cover 4 is closed by a screw cap 24, which can is manually detachable and has a handle.

Pump rotor 17 is constructed with an eccentric for radially driving the pump pistons 25. Each pump piston 25 is biased by a spring 26 to slide radially in a pump casing 27. Pump casing 27 is mounted by a cover plate 29 and screws 28 passing through the cover plate as part of bottom part 2. Inlet and discharge passage are arranged in bottom part 2, especially in protrusion 12, for the axial piston pump formed by pump pistons 25 and pump casing 27. This pump is rather lightweight in comparison with housing bottom part 2.

Motor cover 8 has apertures 30 passing through it. Bottom part 2 is provided with feet 31 having apertures 32 for fastening the device to a stationary element. Bottom part 2 has at least one perpendicular flat mounting point or surface 33 for mounting of at least one hydraulic apparatus, especially a control valve. Passages 34 and 35 pass through bottom part 2 at mounting point 33, and provide inlet and discharge ports to and from the axial piston pump. These passages are some of the passages associated with the axial piston pump in bottom part 2. A discharge opening in bottom part 2 is closed by a discharge screw 36.

Clearances 37 are provided between housing casing 3 and motor casing 7 in the area of housing bottom part 2 for the passage of pressure medium. Motor housing 7 is open to bottom part 2. To prevent the rotation of motor housing 7 radially inwardly projecting ribs or fins 38 are arranged in pair with each tie rod between respective pairs of fins. The tie rods are inside of and do not pass through motor casing 7. Coil 19 is mounted inside of motor casing 7 so that a space exists between motor casing 7 and coil 19.

When screw cap 24 of housing cover 4 is removed, pressure oil can be introduced into housing 1. The oil can also come from the hydraulic circuit to which the axial piston pump is attached. Pressure medium in housing 1 can almost reach housing cover 4 and is found both between housing casing 3 and motor casing 7 and also between motor casing 7 and coil 19. Apertures 30 in motor cover 8 prevent the formation of a layer of air in motor cover 8 when pressure medium passes between motor casing 7 and coil 19. Pressure medium is drawn out of housing 1 during operation of the axial piston pumps by the drive motor and is conveyed into a not shown pressure medium circuit. From the circuit, the pressure medium returns into housing 1.

On account of the thick walls of bottom part 2, this part has a rather large mass. The rotating parts are connected during operation to this bottom part so that the operational noise produced by the rotating parts is absorbed by bottom part 2. The pressure medium found in housing 1 also absorbs noise and cools the motor. The hydraulic elements mounted at point 33 also increases the mass and thus also absorb noise.

Housing casing 3 has a wall thickness less than that of bottom part 2, and thicker walls than motor casing 7. It can have different dimensions, especially a large diameter, with the same connection diameter on bottom part 2. By connection of the rotating parts of the device with bottom part 2, which part has a relatively large mass, a sound bridge between these rotating parts and housing casing 3 is avoided for the most part so that the device works without much noise.

While a particular embodiment has been chosen to illustrate the invention, it will be understood by those skilled in the art that various changes and modifications can be made therein without departing from the scope of the invention as defined in the appended claims.

I claim:

1. A device for conveying a pressure medium, especially oil, comprising:

an electric motor having a perpendicular shaft with opposite ends and having a stator, said motor including a drive rotor mounted on said shaft between said ends;

a pump coupled to and driven by said shaft, and having inlet and outlet means, said pump including a pump rotor between said opposite ends of said shaft;

a thick walled pump housing surrounding said pump;

a motor housing positioned concentrically with said pump housing, said pump housing having a larger diameter than said motor housing such that respective wall ends of said housings are transversely spaced defining a clearance therebetween, said motor housing and said pump housing being fixedly coupled adjacent said wall ends, said motor housing having pairs of longitudinal fins extending axially along and radially inwardly from said motor housing and supporting said rotor;

a motor cover fixedly coupled to said motor housing;

first and second bearings supporting said opposite shaft ends and mounted in said pump housing and said motor housing; respectively;

tie rods located interiorly of said motor housing with each of said tie rods located between a respective pair of said fins, said tie rods connecting said motor cover and said motor housing to said pump housing and preventing relative rotation and movement therebetween;

a housing casing surrounding said motor housing and defining a clearance therebetween, said housing casing being fixedly connected to and sealed to said pump housing;

a housing cover spaced from said motor cover and coupled to and sealed to said housing casing; and said clearances between said housing casing and said motor housing and between said motor housing and said pump housing permitting fluid to flow directly between interior spaces thereof.

2. A device according to claim 1 wherein said housing casing and said housing cover form a cup-shaped part detachably coupled to said pump housing.

3. A device according to claim 1 wherein said pump housing and said pump have approximately equal heights.

4. A device according to claim 1 wherein said pump housing comprises a protrusion supporting said pump.

5. A device according to claim 1 wheein said motor cover is cup shaped; and said motor housing is tubular.

6. A device according to claim 1 wherein said pump housing comprises connection means for mounting an element outside of the device.

7. A device according to claim 1 wherein said motor cover has apertures extending therethrough.

8. A device according to claim 1 wherein said pump housing comprises pressure medium passages coupled to said pump.

9. A device according to claim 1 wherein said pump housing comprises a wall thickness and an outside diameter forming a ratio of said wall thickness to said outside diameter of between 1:30 and 1:70.

10. A device according to claim 1 wheein said ratio is between 1:40 and 1:60.

11. A device according to claim 1 wherein said ratio is about 1:50.

12. A device according to claim 1 wherein said housing casing radially supports said motor housing.

13. A device according to claim 1 wherein pressure medium is located within said housing casing and said motor casing.

* * * * *